US009280920B2

(12) United States Patent
Meng

(10) Patent No.: US 9,280,920 B2
(45) Date of Patent: Mar. 8, 2016

(54) STATUS INDICATING RETRACTABLE CONNECTION LABEL ASSEMBLY

(71) Applicant: Lenovo Enterprise Solutions (Singapore) Pte. Ltd., Singapore (SG)

(72) Inventor: Jian Meng, Ontario (CA)

(73) Assignee: Lenovo Enterprise Solutions (Singapore) Pte. Ltd., Singapore (SG)

( * ) Notice: Subject to any disclaimer, the term of this patent is extended or adjusted under 35 U.S.C. 154(b) by 524 days.

(21) Appl. No.: 13/864,485

(22) Filed: Apr. 17, 2013

(65) Prior Publication Data

US 2014/0311002 A1 Oct. 23, 2014

(51) Int. Cl.

| | |
|---|---|
| ***G08B 21/00*** | (2006.01) |
| ***G09F 3/18*** | (2006.01) |
| ***G09F 3/02*** | (2006.01) |
| ***G09F 3/03*** | (2006.01) |

(52) U.S. Cl.

CPC .. *G09F 3/18* (2013.01); *G09F 3/02* (2013.01); *G09F 3/0335* (2013.01)

(58) Field of Classification Search

CPC ..... G09F 3/18; G09F 3/02; G09F 3/0335; G09F 9/33; G09F 13/04; G08B 21/18; G08B 13/1409; G08B 5/36

USPC ..... 340/635, 815.4, 815.45, 815.47, 691.1, 340/693.5, 638, 641, 652, 687; 40/661, 40/642.02; 439/49, 676, 607.05, 76.1, 67

See application file for complete search history.

(56) References Cited

U.S. PATENT DOCUMENTS

| | | | | |
|---|---|---|---|---|
| 4,271,455 | A * | 6/1981 | McComas | H05K 10/00 340/815.47 |
| 4,679,822 | A | 7/1987 | Wolfe | |
| 5,016,375 | A | 5/1991 | Ngian et al. | |
| 5,097,611 | A | 3/1992 | Smollar et al. | |
| 5,754,112 | A * | 5/1998 | Novak | G06F 11/325 340/332 |
| 5,822,182 | A | 10/1998 | Scholder et al. | |
| 5,911,383 | A | 6/1999 | Jacobsen et al. | |
| 6,617,007 | B1 | 9/2003 | Cram et al. | |

(Continued)

FOREIGN PATENT DOCUMENTS

| | | |
|---|---|---|
| EP | 2146363 A1 | 1/2010 |
| FR | 2819924 A1 | 7/2002 |

(Continued)

OTHER PUBLICATIONS

Dereniowski, et al. "Drawing Maps with Advice", Journal of Parallel and Distributed Computing (2012).

*Primary Examiner* — Anh V La

(74) *Attorney, Agent, or Firm* — Zilka-Kotab, PC

(57) ABSTRACT

The label assembly is comprised of a flexible body with a front and back surface and includes a proximal end and a distal end. The distal end of the flexible body is affixed to the electronic device. A label is attached to the front surface of the flexible body and includes a visual representation of a connection of the electronic device that corresponds to an actual connection of the electronic device as well as an identification mark associated with the visual representation of the connection. The flexible body of the label assembly includes a status indicator displaying a status based on electrical signals associated with the actual connection of the electronic device, and the flexible body includes an electrical connector connecting the status indicator of the flexible body and the electrical signals associated with the actual connection of the electronic device.

20 Claims, 5 Drawing Sheets

(56) References Cited

U.S. PATENT DOCUMENTS

| | | | | |
|---|---|---|---|---|
| 6,783,159 | B2 | 8/2004 | Tuttle et al. | |
| 6,877,264 | B2 | 4/2005 | Mautz | |
| 8,251,707 | B2 * | 8/2012 | Panella | H04L 41/12 439/49 |
| 2004/0084897 | A1 | 5/2004 | Tuttle et al. | |
| 2006/0283956 | A1 | 12/2006 | Conzola et al. | |
| 2009/0051558 | A1 * | 2/2009 | Dorval | G08B 5/36 340/653 |
| 2009/0139126 | A1 * | 6/2009 | Alipour | G09F 3/0289 40/642.02 |
| 2010/0295561 | A1 | 11/2010 | Matero | |

FOREIGN PATENT DOCUMENTS

| | | | |
|---|---|---|---|
| GB | 2470507 | A | 11/2010 |
| JP | 2012171624 | A | 9/2012 |

* cited by examiner

STATUS INDICATING RETRACTABLE CONNECTION LABEL ASSEMBLY

FIELD OF THE INVENTION

The present invention relates generally to improving the labeling of electronic devices, and more particularly to a retractable label for identification and information of electronic devices with a high density of physical connections.

BACKGROUND OF THE INVENTION

Information associated with electronic devices is often located on a back panel or underside of the device, also referred to as a faceplate, which makes access difficult or inconvenient. The information may include items such as a model number, serial number, safety notices and the identity of the manufacturer.

Electronic devices are frequently positioned for front-side access, making access to the information located on a back faceplate or label difficult. Techniques are known that make use of an auxiliary label with more accessible positioning that includes general information associated with the device. Some of these techniques employ labels that insert into the electronic device enclosure and can be extended for viewing when label access is required. The labels can be positioned for convenience and include attachable holders for instances in which the electronic device has limited internal space available to accommodate a label or label-holding structure.

Advancement of electronic device functionality has resulted in higher density of apertures for input, output, power, and peripheral connections, and ventilation requirements. This creates conditions in which information and identification labeling is often obscured, which complicates routine maintenance, problem determination, and corrective actions.

SUMMARY

Embodiments of the present invention disclose a label assembly for connections of an electronic device. The label assembly is comprised of a flexible body with a front surface and a back surface and includes a proximal end and a distal end. The distal end affixed to an anchoring point at or adjacent to the electronic device. The label assembly includes a label attached to the front surface of the flexible body and includes a visual representation of a connection of the electronic device that corresponds to an actual connection of the electronic device. The label assembly also includes an identification mark associated with the visual representation of the connection. The flexible body of the label assembly includes a status indicator displaying a status based on electrical signals associated with the actual connection of the electronic device, and the flexible body includes an electrical connector connecting the status indicator of the flexible body and the electrical signals associated with the actual connection of the electronic device.

DETAILED DESCRIPTION

Embodiments of the present invention include a label assembly that is retractable and flexible, for electronic devices that require identification of connections to and from the electronic device and status information associated with the connections. In various embodiments of the present invention, identification and functional status information for input and output (I/O) connections to an electronic device, are included on a retractable label assembly by attaching electronic indicator display devices to circuitry within or on a flexible label assembly comprised of a label holder and an attached label. Reproduced images of the empty connection faceplate of an electronic device are used in combination with overlaid identification on a retractable flexible label, to produce an accurate representation of the connection information of the electronic device. Additionally, electronic indicators that are attached to the flexible body label holder and correspond to the I/O connections of the electronic device, receive electronic signals from a connection to the electronic device, providing corresponding status information associated with each connection.

Embodiments of the present invention will now be described in detail with reference to the accompanying drawings.

Figure 1A:
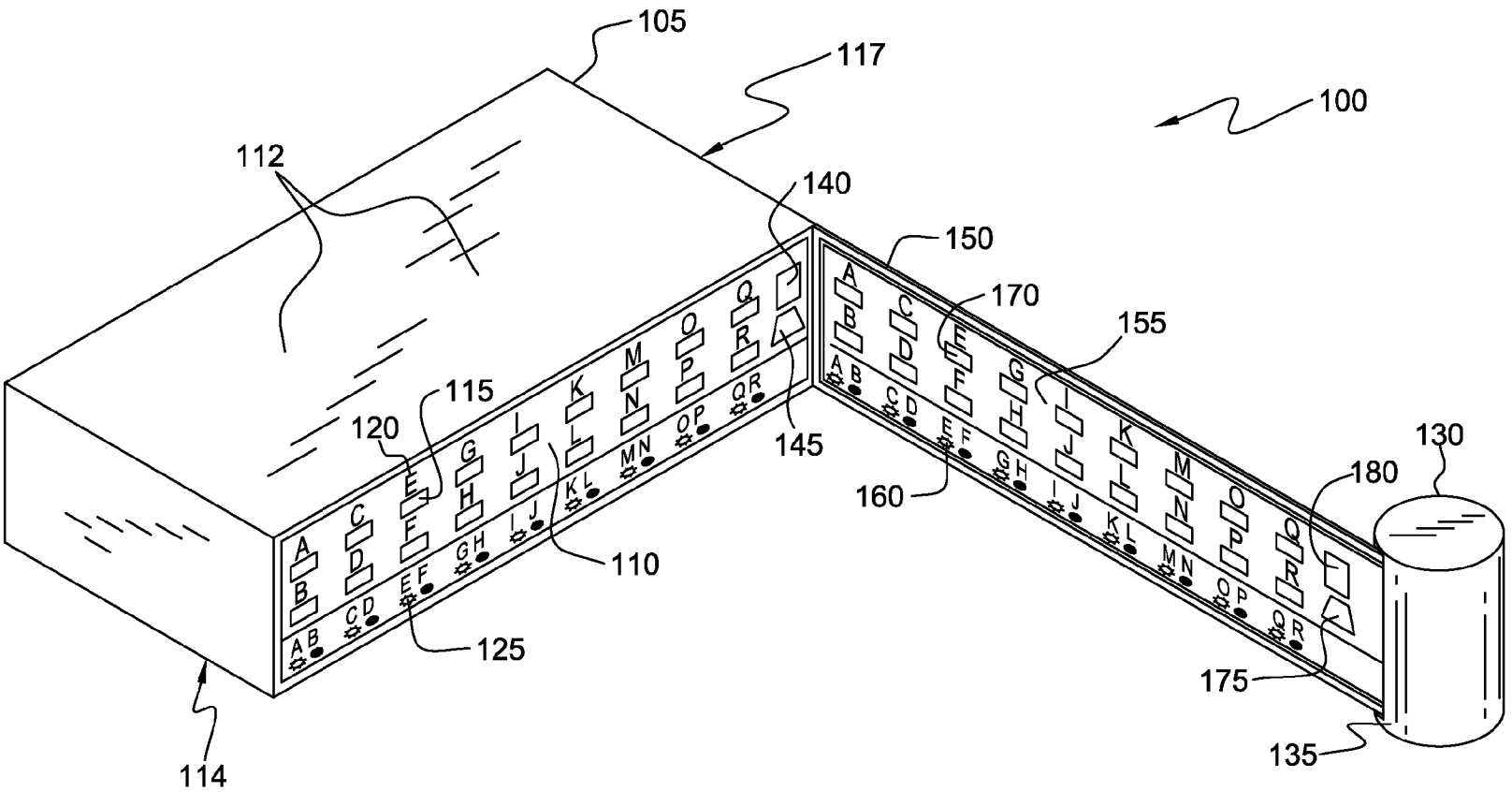
FIG. 1A is a functional block diagram illustrating a flexible label assembly of an electronic device, in accordance with an embodiment of the present invention.

FIG. 1A is a functional block diagram illustrating label assembly 100 of an electronic device, in accordance with an embodiment of the present invention. Label assembly 100 includes electronic device 105, faceplate 110, port 115, port ID 120, status indicator 125, label housing 130, housing slot 135, and auxiliary ports 140 and 145. Label assembly 100 of electronic device 105 is further comprised of label holder 150, which includes label indicator 160. Attached to label holder 150 is label 155 which includes label port image 170, and label auxiliary port images 175 and 180.

In one embodiment of the present invention, electronic device 105 includes connections, which receive and hold inserted cables, wires, wireless transmitters or other connecting elements for electronic device 105. The connections of electronic device 105 receive input, transfer output, provide power or connect to peripheral devices or storage. References to connections, herein referred to as connection ports, include actual physical connections made to the electronic device in which electrical signals, digital signals, or power, are received or transmitted, and include components within or connected to the electronic device.

In various embodiments of the present invention, electronic device 105 can be a desktop computer, a server computer, a network switch, a network hub, a network bridge, a router, a router-switch combination, a telecommunications distribution module, or any device that includes multiple connection ports. For example, electronic device 105 is an internet switch with multiple user connection ports, and auxiliary port 140 for internet service provider access and auxiliary port 145 for a universal serial bus (USB) connection.

Faceplate 110 is an enclosure structure of electronic device 105, typically a front or back side, which includes connection ports, identification of connection ports, and corresponding status indicators in the form of a status light for I/O connection ports. The number of connection ports for faceplate 110 is limited only by the size of electronic device 105 and the physical density of connection ports of electronic device 105. Faceplate 110 is depicted as having multiple connection ports, including port 115 with port ID 120 which provides identification for port 115. Port 115 has a corresponding status indicator light, status indicator 125, which displays various status conditions associated with port 115.

For example, in one embodiment of the present invention, if port 115 is inactive, status indicator 125 is blank, displaying no light and indicating inactivity. If port 115 is active but not sending output or receiving input, it displays a steady light. When port 115 is sending output or receiving input, it displays a flashing light indicating it is actively sending and/or receiving signals. Faceplate 110 also depicts auxiliary ports 140 and 145 which represent additional connections to electronic device 105, for example, an Ethernet connection for an internet service provider and a USB connection, respectively. Faceplate 110 may include any type or number of connection ports, and may have multiple status indicators corresponding to a connection port.

For example, the multiple connection ports of faceplate 110 are each identified by designations "A" through "R", respectively. Port 115 is associated with port ID 120 of faceplate 110, which has the designation "E", and associated with status indicator 125. Port 115 receives connection of a cable, wire or connection device and provides services associated with the connection. For example, port 115 may provide internet access, telephone service access, wireless service or other service or access to the device connected to port 115.

Port ID 120 is an identification mark associated with port 115. Each connection port of faceplate 110 includes an associated identification mark, which may be positioned generally adjacent to the port with which it is associated, such that an observer of faceplate port ID 120 associates the ID mark with port 115.

Label holder 150 includes label 155, label indicator 160, and connection point 185 (not shown). Label holder 150 is a flexible body constructed of a pliable material, typically in the shape and size of the faceplate that it represents, such as faceplate 110. The pliable material enables label holder 150 to attach to and bend around a cylindrical shaped rod in a spiral orientation allowing label holder 150 to be stored in a retractable enclosure. Label holder 150 includes attachment surface 350 (FIG. 3B) to which label 155 is attached.

Label holder 150 includes circuitry to enable status indicators, such as label indicator 160, to display visual status information regarding the actual connections associated with the label status indicator. Label holder 150 makes an electrical connection to a component of electronic device 105 that provides electrical signals indicating the status of connection ports of faceplate 110, so that the connection port status is displayed via label indicators on label holder 150.

For example, label indicator 160 displays a steady illuminated light as a status, indicating that port 115, which is the connection port associated with label indicator 160, is active, but currently neither sending output or receiving input. The pliable material of which label holder 150 is constructed possesses dielectric properties that insulates low voltage circuitry included on, or within the pliable material. For example, label holder 150 may be comprised of one or more sheets of pliable polyimide material. The polyimide material is processed to include conductive circuitry capable of propagating an electric current, which is on or enclosed within pliable polyimide material.

Label housing 130 is an encasement for label holder 150, which retracts into label housing 130, when no pulling force is applied to label housing 130. The proximal end of label holder 150 is affixed or otherwise attached, by connection point 185, to an internal component of label housing 130 (discussed further with respect to FIG. 2A). In one embodiment, label holder 150 is attached at its distal end to surface 117 of electronic device 105. Surface 117 is a side of electronic device 105 attached on one edge to an edge of top 112, attached on the opposite edge to an edge of bottom 114 and perpendicular to faceplate 110. Label housing 130 is held in place at or near electronic device 105 by tension applied to label holder 150 from a retracting device within label housing 130, for example a coiled spring, when label holder 150 is fully retracted.

Label housing 130 includes a top, generally parallel to a bottom, and has a length, width and a general body shape that accommodates the spiral orientation of label holder 150 when fully retracted within label housing 130, such as a cylindrical shape or polygon shape. Label housing 130 can be made of one or a combination of metal, plastic, or carbon-fiber materials. Label housing 130 includes housing slot 135, which is a vertical opening located on a side of label housing 130, extending a distance between the top and bottom of label housing 130 to accommodate the height of label holder 150. Housing slot 135 provides a passage for flexible label holder 150 to extend from and retract into, label housing 130.

In one embodiment of the present invention, grasping and pulling label housing 130 in a direction away from electronic device 105, aligned with and parallel to the side of electronic device 105 to which label holder 150 is attached, extends label holder 150. Returning label housing 130 to the position near or in contact with electronic device 105 results in label holder 150 retracting into label housing 130. In another embodiment, label housing 130 is immovably attached to electronic device 105 and grasping a portion of label holder 150 extending external to label housing 130, and pulling away from electronic device 105 in a generally perpendicular direction, in the same general plane as faceplate 110, extends label holder 150. Relaxing the force to extend label holder 150 results in retraction of label holder 150 into label housing 130.

Label indicator 160 which is an electronic indicator, electrically connected to label holder 150 and receives electrical signals from circuitry on or within label holder 150. The circuitry on or within label holder 150 is connected to an electrical component of electronic device 105 that provides the electrical signals indicating the status of corresponding connection ports on faceplate 110. Signals received by label indicator 160 produce a visual display indicating a status condition of a corresponding connection in electronic device 105, but presented from an easily accessible label. For example, label indicator 160 is an indicator device connected to label holder 150 and receiving electrical signals though circuitry within or on label holder 150. The status display of label indicator 160 corresponds to status indicator 125 on electronic device 105, both corresponding to port 115, depicted as "A" by port ID 120 of electronic device 105. In one embodiment of the present invention, label indicator 160 displays a steady visual light indicating port 115 is active, but not currently sending output or receiving input, or displays a blinking light when either receiving input or sending output, or is blank and displays no light when port 115 is inactive.

Attached to label holder 150 is label 155, which includes a visual representation of the actual connections of faceplate 110, referred to as connection images, and the images of identification marks associated with the actual connections of faceplate 110. Label 155 maps the positions of the connection images to correspond to the positions of the associated connection ports of faceplate 110.

Label 155 may be made of paper material, cellulose acetate material, or other material on which the features and information of a faceplate, such as faceplate 110, can be applied. The connection images and identification marks may be placed on these materials by printing, copying, drawing, painting engraving, staining, screen printing, and in some cases, chemical or laser etching. Label 155 is a visual reproduction of the connection ports and information of faceplate 110. Label 155 is modified to provide for the display of port status indicators, such as label indicator 160, and comprised of a material on which visual reproductions can be placed, for example, by printing.

Label 155 is attached to the surface of label holder 150 in a manner that allows the status indicators on label holder 150 to display the status of their corresponding connection port. For example label indicator 160, which is attached to label holder 150, remains visible after label 155 is attached to the front surface of label holder 150 (see attachment surface 350, FIG. 3B) and receives duplicate status indication signals as status indicator 125, which is the corresponding indicator on faceplate 110. Both status indicator 125 and label indicator 160 display the status associated with port 115. In one embodiment of the present invention, status indicator 125 is not required for indication of the status of port 115 as a result of implementing label 155 and label holder 150 that includes label indicator 160.

Figure 1B:
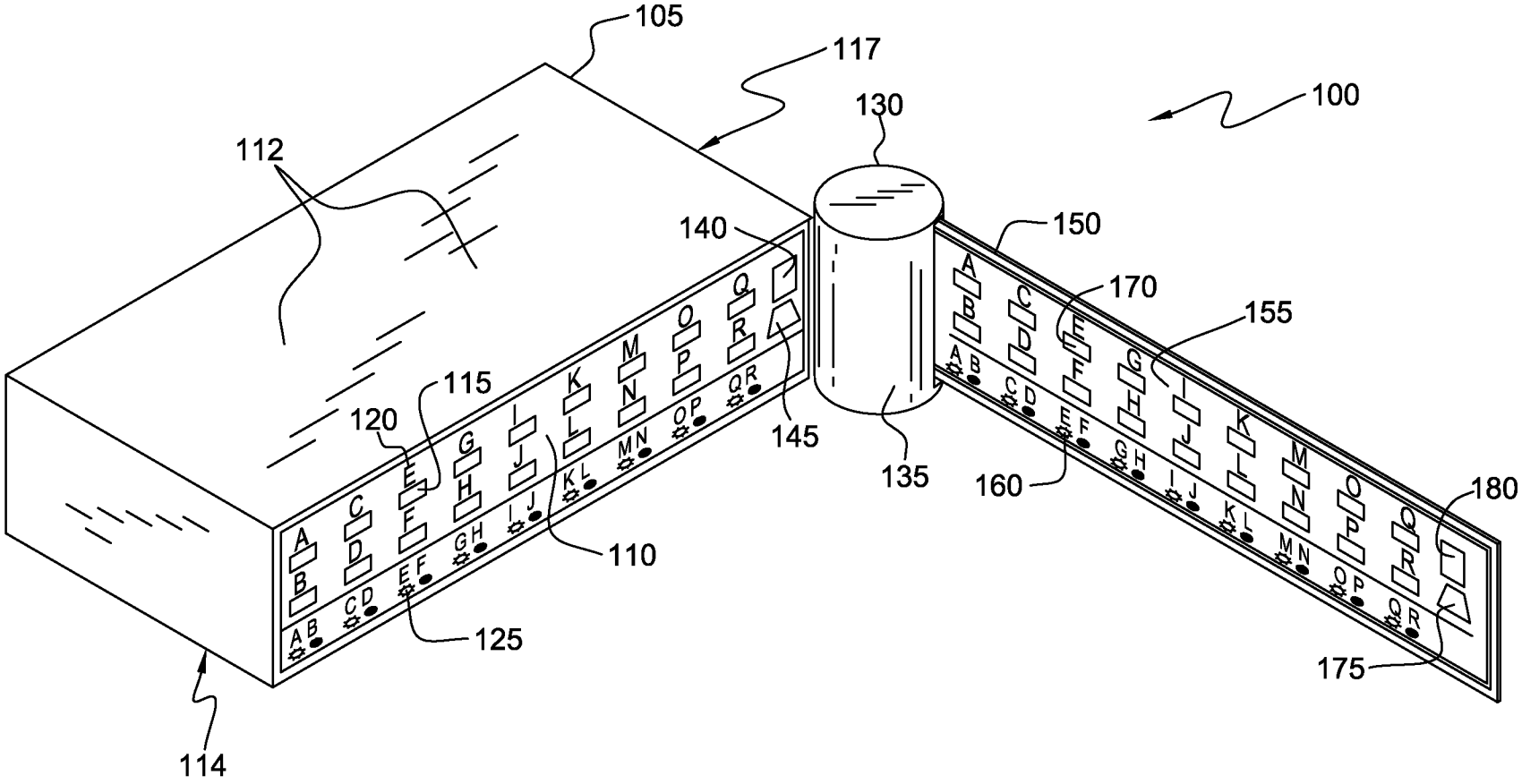
FIG. 1B is a functional block diagram illustrating a flexible label assembly including a relocated label holder, in accordance with an embodiment of the present invention.

FIG. 1B is a functional block diagram illustrating label assembly 100, including a relocated label housing 130, in accordance with an embodiment of the present invention. In an alternative embodiment, label holder 150 is attached at its distal end by connection point 187 (not shown), to an internal component of label housing 130, vertically aligned in a central position within label housing 130. Label housing 130 is depicted as anchored to surface 117 of electronic device 105, with positioning to provide unobstructed access and electrical connection enabling the status indicators, for example, label indicator 160 on label holder 150. The length of label holder 150 retracts into label housing 130 with a portion of label holder 150 remaining extended, enabling label holder 150 to be extended by a pulling force applied to the proximal end of label holder 150 at connection point 185. Various connectors may be attached to connection point 185 to facilitate grasping and extending label holder 150. Label holder 150 retracts into label housing 130 when the pulling force is removed.

Figure 2A:
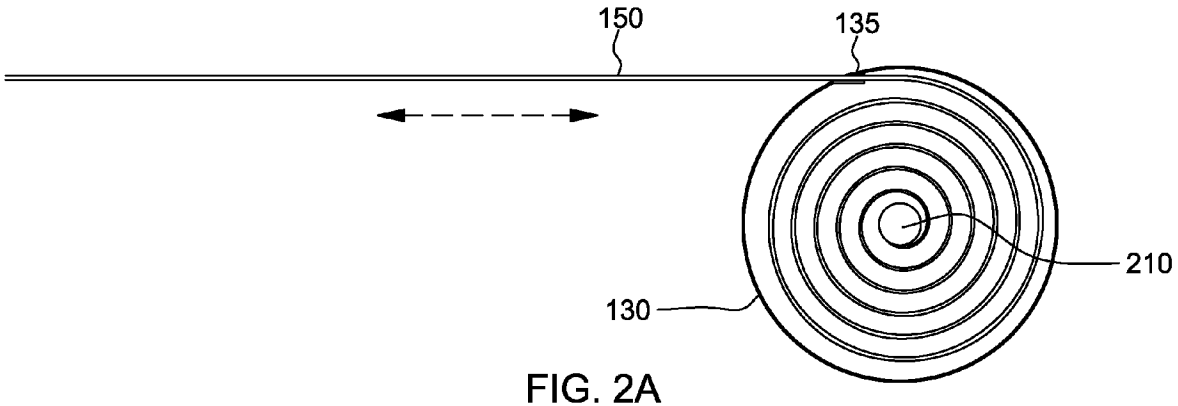
FIG. 2A is a block diagram illustrating a view through the top of a label housing in accordance with an embodiment of the present invention.

FIG. 2A illustrates a block diagram illustrating a view through the top of label housing 130, in accordance with an embodiment of the present invention. Label housing 130 is depicted with label holder 150 partially retracted, through housing slot 135, in a spiral orientation, within label housing 130. Retraction rod 210 is located at a center position within label housing 130 and in one embodiment, serves as a point of attachment for the proximal end of label holder 150 at connection point 185 (not shown).

Figure 2B:
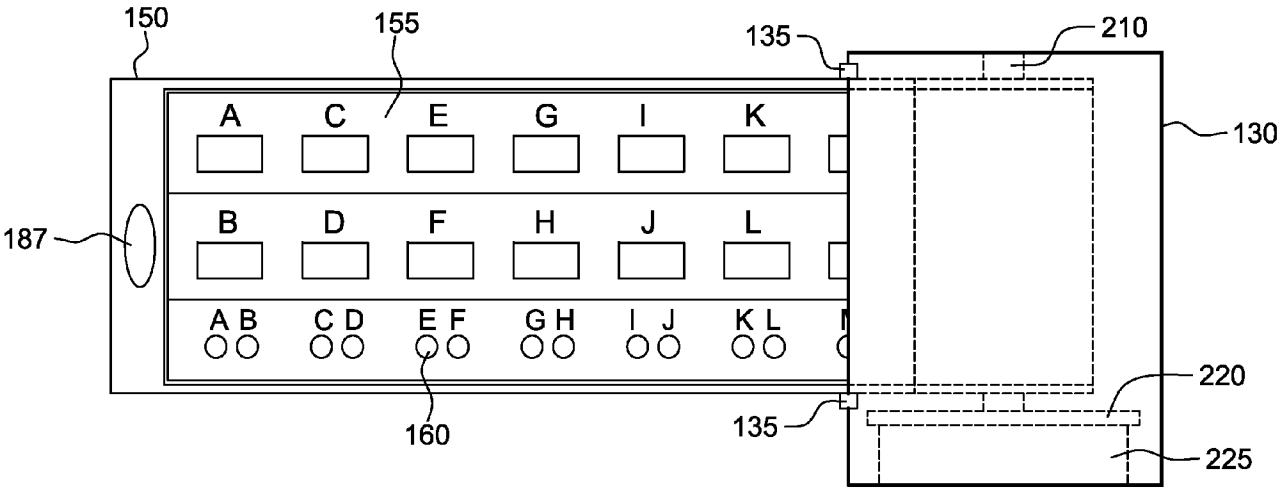
FIG. 2B depicts a block diagram illustrating a view through the side of a label holder including a retractable label holder and label, in accordance with an embodiment of the present invention.

FIG. 2B depicts a block diagram illustrating a view through the side of label housing 130 including retractable label holder 150 and label 155, in accordance with an embodiment of the present invention. Label 155 is shown attached to label holder 150, which includes label indicators, such as label indicator 160. Positioned at the distal end of label holder 150 is connection point 187, which attaches to electrical device 105. Label housing 130 includes retraction rod 210, retraction spring housing 220, retraction housing base 225, and housing slot 135. Retraction rod 210 is attached at a lower end to a central position of retraction spring housing 220, and extending through the upper surface of retraction spring housing 220. Retraction rod 210 is attached at its upper end to the top of label housing 130. The attachment of both the upper end and lower end of retraction rod 210 allows for free rotation of retraction rod 210.

Retraction spring housing 220 is a shallow cylindrical shaped disk with a top surface oriented towards the top of label housing 130, and an open end facing away from the top of label housing 130, towards the open end of retraction housing base 225. Retraction spring housing 220 has a diameter greater than retraction rod 210 and is attached at its center position to the lower end of retraction rod 210, which extends through the center of the top surface of retraction spring housing 220.

Retraction housing base 225 is a shallow cylindrical shaped disk attached to the bottom surface of label housing 130 and with side walls extending upward to an open end. The diameter of retraction housing base 225 is less than the diameter of retraction spring housing 220 so that retraction spring housing 220 fits over the side wall and sets on retraction housing base 225, allowing rotation of retraction spring housing 220. Retraction housing base 225 includes a spring for self-retraction of label holder 150 within label housing 130. The spring is coiled in a spiral orientation within retraction housing base 225 and is attached at one end to the lower end of retraction rod 210 extending through retraction spring housing 220. The other end of the spring is attached to retraction housing base 225. The spring is coiled to create tension when retraction rod 210 is rotated in a direction associated with extending label holder 150 and tension is relieved when label holder 150 is retracted within label housing 130.

Figure 3A:
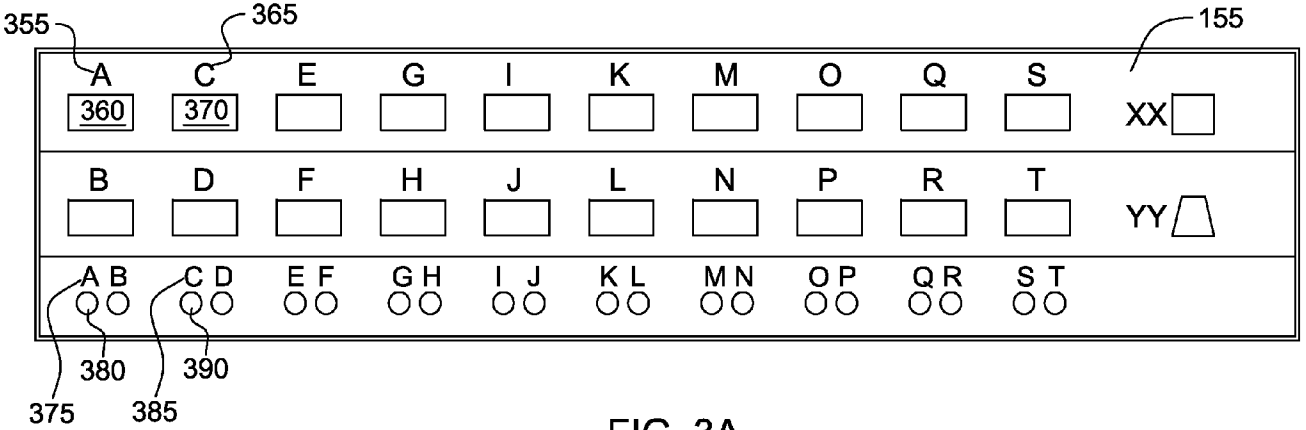
FIG. 3A is a block diagram illustrating a label, in accordance with an embodiment of the present invention.

FIG. 3A is a block diagram depicting label 155, in accordance with an embodiment of the present invention. Label 155 is an attachable sheet that includes markings for label port IDs 355 and 365, label connector port images 360 and 370, label indicator clearance spaces 380 and 390, and label indicator IDs 375 and 385. Label 155 includes visible surface markings that represent the position and arrangement of connection ports and connection port IDs of faceplate 110, attached to electronic device 105. Images from faceplate 110 may be placed on these materials by printing, copying, drawing, painting, engraving, staining, screen printing, and in some cases, chemical or laser etching. Label 155 also includes clearance spaces, which are areas in which label material has been removed, that are aligned with the position of label indicators on label holder 150 and allow the visual status indications to be viewed.

Figure 3B:
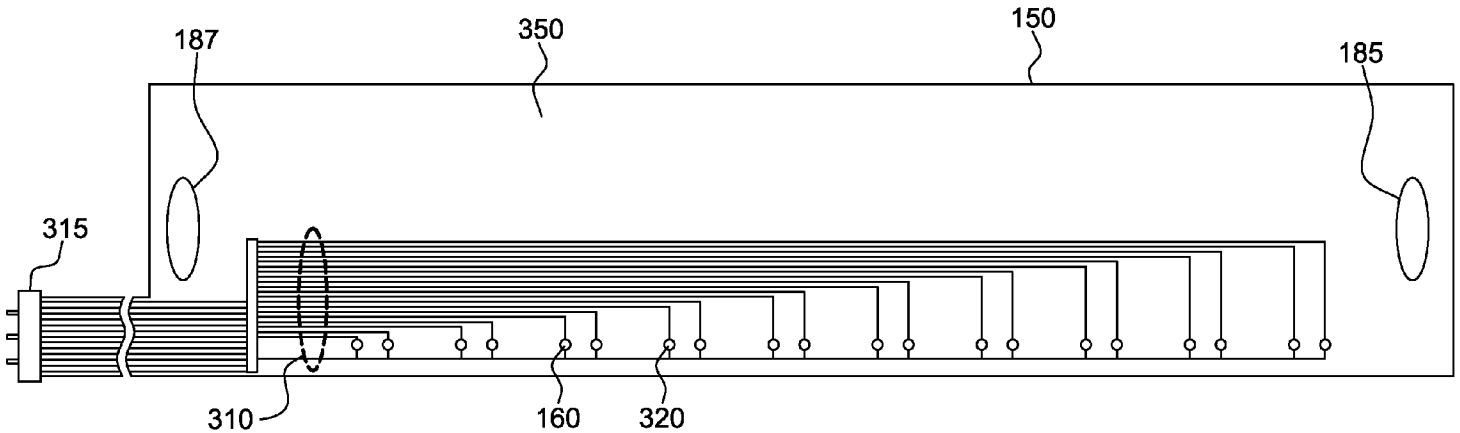
FIG. 3B is a block diagram illustrating a label holder, including signal circuitry and status indicators, in accordance with an embodiment of the present invention.

In one embodiment of the present invention, label 155 is a photographic image of a connection port faceplate for an electrical device, which is attached to label holder 150 providing accurate representation of connection ports, connection IDs and any additional information associated with faceplate 110 of electronic device 105. Label 155 is positioned on label holder 150 so that label indicator clearance space 380 overlays label indicator 160, and label indicator clearance space 390 overlays label indicator 320 (FIG. 3B). Label indicator clearance space 380 and 390 represent areas of label 155 at which label material has been removed, leaving an open, visible area free of coverage from label material. Alternatively, label 155 may include transparent material for label indicator clearance spaces 380 and 390. Open areas or transparent materials for label clearance spaces 380 and 390 allow the visual status of label indications 160 and 320 to be viewed.

Label 155 is attached to label holder 150 by techniques that hold label 155 in a stable position, which may include the use of adhesives, compression clips, or hook-and-loop fasteners, to attach label 155 to attachment surface 350 (FIG. 3B), of label holder 150. For example, in one embodiment of the present invention, label 155 is produced by applying a photographic image of a faceplate, such as faceplate 110, which is printed onto photographic paper material with an adhesive backing and applied to attachment surface 350 of label holder 150. In another embodiment, label 155 is detachably attached to label holder 150 using corresponding hook-and-loop connections; one connection attached to label holder 150 and the other corresponding hook-and-loop connection attached to label 155, making label 155 removable. The photographic image of the faceplate is a digital image and may be edited using photo editing software. The image of the faceplate is edited to enhance the labeling information on the faceplate to improve recognition and identification as appropriate, for example, increasing size, adding colors, or changing contrast.

In an alternative embodiment, label 155 includes markings that provide information associated with components within electronic device 105, for example a hard drive, and label holder 150 includes label indicators that provide visual status information associated with the components of electronic device 105. In one embodiment, label holder 150 may include a label on the front side of label holder 150 that includes a visual representation of faceplate 110 and corresponding electrical status indicators, and a label on the back side of label holder 150 that includes one or both of: information associated with electronic device 105 and components of electronic device 105. A second label (not shown) m Label 155 and label holder 150 are used together to enhance accessibility to general information, identification, and status for connections to and components of electronic devices.

Label port ID 355 identifies an adjacent label connection port image, which corresponds to an actual connection port at the same respective position on the connection port faceplate of an electronic device. For example, label port ID 355, designated as "A", is the identification for label port image 360. Each label connection port image on label 155 has a corresponding label connection port ID, for example, label port IDs 355 and 365 correspond to label port images 360 and 370, respectively. In one embodiment of the present invention, label port ID 355 is included in a photographic image of a faceplate of an electronic device, for example, faceplate 110 of electronic device 105. In other embodiments, label port ID 355 results from editing a digital photographic image of a faceplate, using photo editing software, or other editing technique.

FIG. 3B depicts a block diagram of label holder 150, including signal circuitry and label status indicators, in accordance with an embodiment of the present invention. Label holder 150 is shown as including connection point 187 at the distal end of label holder 150, connection point 185 at the proximal end, circuit connector 315, signal circuit 310, and label indicators 160 and 320.

In one embodiment, label holder 150 is constructed of polyimide sheets at least one of which has a copper surface that has been processed to form signal circuit 310 by using photolithography and chemical etching techniques. Photolithography is a technique that exposes a pattern to a light-sensitive photo resist applied to a substrate material. The photo resist pattern protects the underlying material. A series of chemical treatments then either removes excess conductive material, revealing the exposed pattern on the material underlying the resist, or enables deposition of a new material in the exposed pattern as defined by the resist, onto the underlying substrate material. Signal circuit 310 is comprised of circuit lines that transmit electrical current to status indicators, such as label indicators 160 and 320. Each status indicator corresponds to a respective connection port and duplicates or replaces the status display of status indicators on faceplate 110 (FIG. 1A). Label indicator 160 displays the status signal of a connection port on faceplate 110, by connecting a small light emitting diode (LED) to a circuit of signal circuit 310, on or within label holder 150. LEDs are attached to the circuit contacts of signal circuit 310, for example, by applying a soldering process. Label indicators 160 and 320 are connected to respective circuits of signal circuit 310, such that the status signals received by label indicators 160 and 320 correspond to their respective connection ports on faceplate 110.

In other embodiments, other base materials may be used to create label holder 150, such as: polyester, polyethylene napthalate, or fluropolymers materials, for example, and conductive surfaces, such as copper foil, may be applied with an adhesive and signal circuitry created by etching or milling processes. Alternatively, signal circuit lines may be applied with a screening process using conductive pastes, or lasers may be used to define circuit patterns. A protective coating can be applied to one-sided circuitry instead of using a second sheet of base material to insulate and protect circuitry. In yet other embodiments, a logic circuit may be used to control the display of status indicators, which may reduce the required circuitry. In still other embodiments, wireless technology, for example Bluetooth®, may be used to provide status signal logic to the status indicators on label holder 150.

In one embodiment of the present invention, a second sheet of polyimide is combined with the circuit-containing polyimide sheet that includes LED status indicators, so that the circuitry is insulated by polyimide. The second sheet has polyimide material removed from the areas that correspond to the LED status indicators locations of the first polyimide sheet. The polyimide material may be manually removed from the LED indicator areas by drilling, for example, or by use of photolithography patterning and chemical etching. In this manner the circuitry remains protected and the status indicator LEDs are visible.

For example, a first sheet of polyimide material is laminated with copper foil and a photo-sensitive resist is applied to the copper surface. The circuitry image is projected on the photo-sensitive resist using a light source appropriately matched to photo-sensitive material. Developing the photo-sensitive resist that does not cover the desired circuit pattern is removed. The exposed copper surface is removed using a chemical etch, and the photo-sensitive resist remaining is stripped off, leaving the circuitry pattern that it covered. LEDs are placed on exposed copper pads and attached by soldering the LED pads to the circuit copper pads on the polyimide material. A second sheet of polyimide material is applied to the first polyimide sheet by lamination, adhesive, or other bonding technique. Material from the second sheet of polyimide is removed from areas that correspond to the LED attachment pads of the circuitry pattern on the first sheet of polyimide.

Circuit connector 315 connects to electrical device 105 and provides electrical signals to the status indicator LEDs on label holder 150 that correspond to their respective connection port. Circuit connector 315 may connect by plugging into the main circuit board or mother board of the electrical device that is configured with a receiving connector corresponding to circuit connector 315, and providing status signals to the status indicator LEDs on label holder 150. Alternatively, circuit connector 315 may connect to a signal splitter that duplicates electrical signals for the status of connection ports of electrical device 105 and provides the duplicated signals to the status indicators of label holder 150, via circuit connector 315.

In an exemplary embodiment, a label indicator, for example label indicator 160, receives a steady signal to indicate an active-waiting mode, in which the connection port is active, but is waiting for input to be received or output to be sent. The label indicator receives an intermittent signal to indicate actively transmitting or receiving, and receives no signal and displays an absence of a visual indicator, such as not displaying any light, when the connection is not enabled. In another embodiment, different signals may be used to indicate specific information regarding the state or condition of the connection.

Figure 4A:
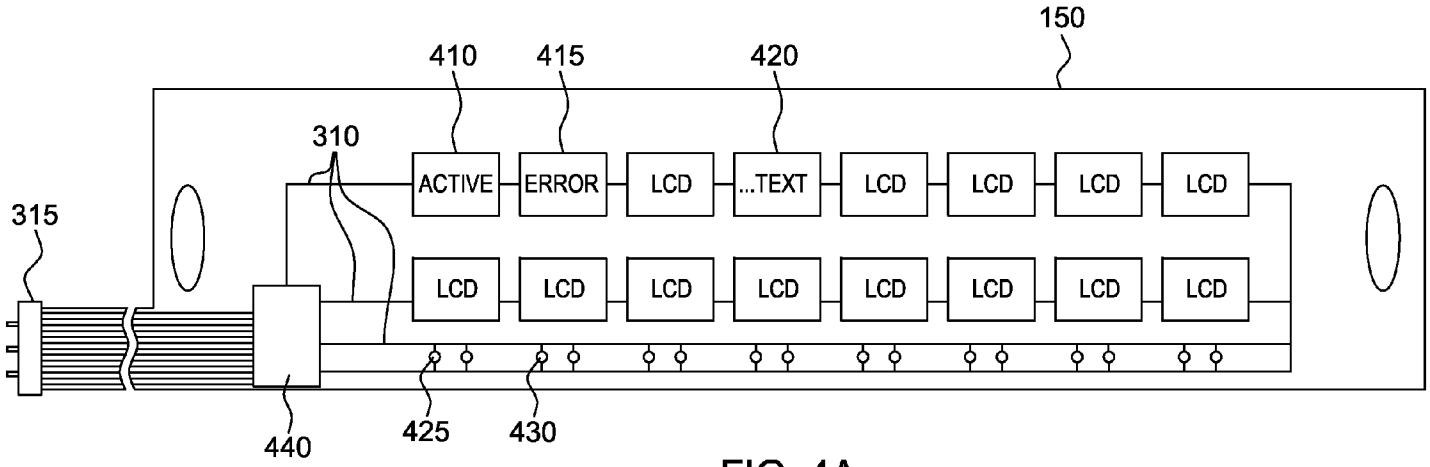
FIG. 4A is a block diagram illustrating a flexible label holder including status indicators, in accordance with an embodiment of the present invention.

FIG. 4A illustrates a flexible label holder including status indicators, in accordance to embodiments of the present invention. Alternative status indicators may be used in presenting the status information associated with corresponding actual connection ports on faceplate 110. Shown in FIG. 4A is label holder 150 including label displays 410, 415 and 420, which are positioned to correspond to associated connection ports on faceplate 110. In one embodiment of the present invention, label displays 410, 415 and 420 are micro-sized liquid crystal displays, commonly known as LCDs, attached to electrical circuit connection points on label holder 150. Label displays 410, 415, and 420 receive electrical signals via signal circuitry 310 and display status information that is associated with their respective corresponding connection port on faceplate 110. Active matrix LCDs have dot matrix display capability, in which the LCD display area is comprised of pixels that are individually controlled. This enables label displays 410, 415, and 420 to display text, numerals, graphical images or scrolling messages that can identify a connection port, indicate the connection port's state, display error codes and even stream a diagnostic message. LCDs require a microcontroller to receive and transmit the data to display on an LCD as well as managing which data to display on which LCD. Flexible label holders that include attached LCDs may require a label holder with a larger diameter, or an alternative retraction technique requiring a reduced amount of label holder bending.

For example, label display 410 is shown indicating that the corresponding connection port is active by displaying the text "ACTIVE", and label display 420 is shown presenting a scrolling message of information that is associated with the corresponding connection port on faceplate 110. Label display 415 is shown presenting the text "ERROR", indicating an error has occurred with the corresponding connection port on faceplate 110. Label display 415 may alternate between displaying an error state and displaying an error code or error message, which is useful in diagnosing problems with the corresponding connection port on faceplate 110. In addition to displaying the status or error message associated with a corresponding connection, label displays can present the label port ID associated with the connection port, minimizing the need for additional identification markings on the label. Attaching LCDs to label holder 150 that correspond to connection ports on faceplate 110, enables label holder 150 to provide information beyond what is available by LED status indicators and makes the information more accessible.

Label holder 150 is shown to include circuit controller 440, which receives status signals from electronic device 105 associated with the connection ports of faceplate 110 and distributes the signals to the corresponding LCD on label holder 150. Circuit controller 440 is shown connected to signal circuitry 310 and is positioned at an end of label holder 150 to minimize the stress and impact of label holder 150 bending when retracting into label housing 130. Alternatively, circuit controller 440 is positioned to be unaffected by the bending of label holder 150 when retracted, for example circuit controller 440 may be positioned within label housing 130, at or near circuit connector 315 or within electronic device 105, or circuit controller 440 may reside within electronic device 105, for example, on the main circuit board connected to label holder 150 via an adapted connector 315.

Label holder 150 also is also shown as including label indicators 425 and 430. Label indicators 425 and 430 are LEDs that indicate the status of their corresponding connection port, and are shown to indicate that implementations of embodiments of the present invention may include combinations of status indicator types. Label indicator 425 and 430 will present status information conveyed by various light displays, whereas label displays 410, 415, and 420 convey text or graphical information associated with the corresponding connection port on faceplate 110.

In another embodiment of the present invention, the status indicators of FIG. 4A are radio-frequency identification (RFID) chips, which are attached to label holder 150 and provide identification of the corresponding connection ports. Attached RFID chips are referred to as "tags" and passive tags transmit identification information when exposed to the radio energy transmitted by an RFID reader, or interrogator. RFID tags can also be "active tags" having battery power or access to an electrical power source used to transmit their associated identification information. RFID tags used as status indicators on label holder 150 can transmit identification of corresponding connection ports to an RFID reader, and receiving status information from electronic device 105, can transmit status information, in the form of a code.

In another embodiment of the present invention, the status indicators depicted in FIG. 4A are micro-sized electronic speakers, which present an audio identification of an identification mark for a corresponding connector port of faceplate 110, and an audio indication of the status of the corresponding connector port. The electronic speaker is activated by an initiating switch, which for this embodiment may be on label holder 150 in the position held by label indicator 425. The delivery of information includes connector port identification and status information in an audio format including a message including one or more of: synthesized or recorded language, sounds, and codes.

Figure 4B:
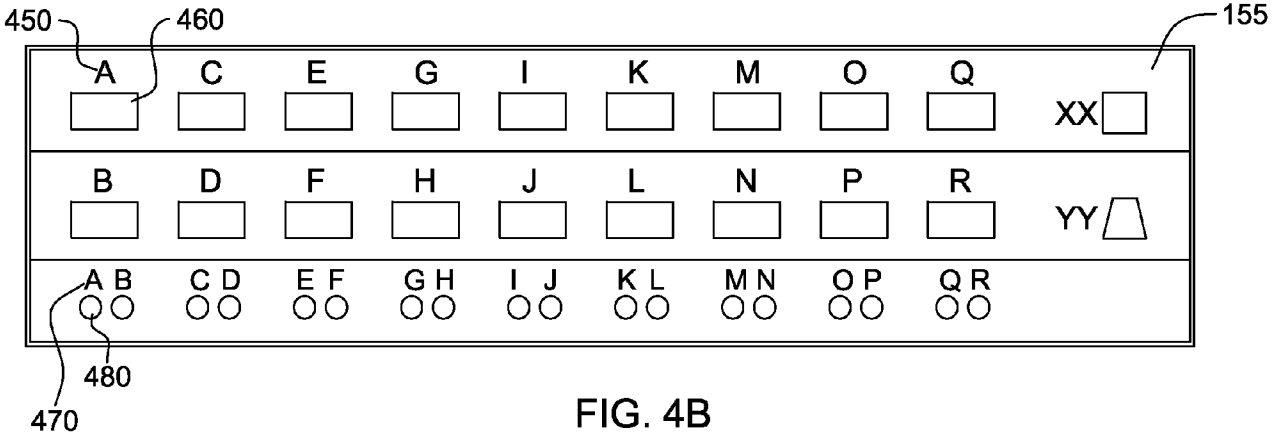
FIG. 4B is a block diagram illustrating a label for a label holder that includes status indicators, in accordance with an embodiment of the present invention.

FIG. 4B is a block diagram illustrating a label for a label holder that includes LCD status indicators, in accordance with an embodiment of the present invention. Label 155 is shown including label port ID 450, label LCD space 460, label indicator space 480 and label indicator ID 470. Label LCD space 460 is an open area of label 155, free of label material, or alternatively, label LCD space 460 is comprised of transparent material. Label 155, when applied to label holder 150, is positioned in an orientation that allows full view of label display 410 (FIG. 4A), with label LCD space 460 surrounding label display 410. Label 155 includes additional label LCD space areas corresponding to additional LCD label displays on label holder 150. Label port ID 450 provides identification for label display 410 and corresponds to the connection port on faceplate 110 for which label display 410 provides status information. In one embodiment, label port ID 450 is optional if label display 410 also displays the ID of the corresponding connection port.

What is claimed is:

1. A label assembly for an electronic device, comprising:

a flexible body with a front surface and a back surface, including a first end and a second end, the first end including a first attachment area with an electrical connector attached to the electronic device, the second end including a second attachment;

a label attached to the front surface of the flexible body including a visual representation of a connection of the electronic device that corresponds to an actual connection of the electronic device and includes an identification mark associated with the visual representation of the connection;

the flexible body including a status indicator that presents a status, wherein the status is a condition of the actual connection of the electronic device based on electrical signals received by the status indicator, from the electronic device; and the electrical connector connecting the status indicator of the flexible body and the electrical signals associated with the actual connection of the electronic device.

2. The label assembly of claim 1, wherein the flexible body is retractably attached to a retracting device.

3. The label assembly of claim 2, wherein the second attachment area of the flexible body is retractably attached to the retracting device, the label and the flexible body forming a spiral orientation within the retracting device, when retracted.

4. The label assembly of claim 2, wherein the first attachment area of the flexible body is retractably attached to the retracting device, the retracting device is attached to the electronic device, and the label and the flexible body forming a spiral orientation within the retracting device, when retracted.

5. The label assembly of claim 1, wherein the front of the flexible body includes a label detachably attached to the flexible body, and the back of the flexible body is blank.

6. The label assembly of claim 1, wherein the back of the flexible body includes a second label, wherein the second label includes one or both of: information associated with the electronic device and information associated with components within the electronic device.

7. The label assembly of claim 1, wherein the status indicator is an LED (light emitting diode) that indicates the status of the actual connection of the electronic device.

8. The label assembly of claim 7, wherein the LED indicates the status of the actual connector of the electronic device based on displaying one or a more of: a steady light, a pattern of blinking light, an absence of light.

9. The label assembly of claim 1, wherein the status indicator is comprised of an LCD (liquid crystal display) that indicates one or both of: the identification mark associated with the visual representation of the connection and the status of the actual connection of the electronic device.

10. The label assembly of claim 9, wherein the LCD indicates one or both of: the identification mark associated with the visual representation of the connection and the status of the actual connection of the electronic device based on displaying one or more of: flashing, text, one or more numerals, a streaming message, a graphic.

11. The label assembly of claim 1, wherein the status indicator is comprised of an RFID tag (radio-frequency identification tag) that indicates one or both of: the identification mark associated with the visual representation of the connection and the status of the actual connection of the electronic device.

12. The label assembly of claim 11, wherein the RFID tag indicates one or both of: the identification mark associated with the visual representation of the connection and the status of the actual connection of the electronic device based on one or more of: a radio frequency message including a connector ID, a status code, an error code.

13. The label assembly of claim 1, wherein the flexible body is comprised of a material having dielectric properties for insulating low voltage circuitry.

14. The label assembly of claim 1, wherein the flexible body is comprised of polyimide material.

15. The label assembly of claim 1, wherein the label is a photo image of the actual connection of the electronic device.

16. The label assembly of claim 15, wherein the label includes one or more markings added to the photo image of the actual connection of the electronic device.

17. The label assembly of claim 1, wherein the label is removable from attachment to the flexible body by using corresponding hook-and-loop fasteners, one corresponding hook-and-loop fastener attached to the label and another corresponding hook-and-loop fastener attached to the flexible body.

18. The label assembly of claim 1, wherein the status indicator displaying a status based on the electrical signals associated with the actual connection of the electronic device is attached to electronic circuitry of the flexible body and visibly free of coverage by the label attached to the front surface of the flexible body.

19. The label assembly of claim 1, wherein the electrical connector provides an electrical signal to the status indicator, associated with a status of the actual connection of the electronic device.

20. The label assembly of claim 1, wherein the status indicator is an electronic speaker, the electronic speaker indicating one or both of: the identification mark associated with the visual representation of the connection and the status of the actual connection of the electronic device, based on an audio presentation including one or more of: synthesized or recorded language, sounds, and codes.

* * * * *